United States Patent [19]

Goldblatt

[11] 4,133,239

[45] Jan. 9, 1979

[54] KICKBACK-FREE SAW CHAIN

[75] Inventor: Lawrence Goldblatt, Hamilton, Canada

[73] Assignee: Jessie Goldblatt, Hamilton, Canada

[21] Appl. No.: 807,658

[22] Filed: Jun. 17, 1977

[51] Int. Cl.[2] ..... B27B 33/14

[52] U.S. Cl. ..... 83/834

[58] Field of Search ..... 83/834, 833, 830

[56] References Cited

U.S. PATENT DOCUMENTS

| | | | |
|---|---|---|---|
| 2,826,226 | 3/1958 | Donley | 83/834 |
| 2,872,956 | 2/1959 | Gudmundsen | 83/834 |
| 2,923,329 | 2/1960 | Gudmundsen | 83/834 |
| 2,963,055 | 12/1960 | Stihl | 83/834 |
| 3,180,378 | 4/1965 | Carlton | 83/834 |
| 3,329,183 | 7/1967 | Robinson | 83/834 |
| 3,735,662 | 5/1973 | Anderson | 83/830 |
| 3,910,148 | 10/1975 | Weiss | 83/833 |
| 3,951,027 | 4/1976 | Arff | 83/834 |

*Primary Examiner*—Frank T. Yost

*Attorney, Agent, or Firm*—Schuyler, Birch, Swindler, McKie & Beckett

[57] ABSTRACT

A saw chain is disclosed having a novel safety link bearing an upstanding cam portion with an upwardly and rearwardly inclined leading edge and a rearwardly projecting tail which pivots outwardly as the chain traverses the rounded nose of a saw bar to provide a reduced effective depth gauge setting for a following cutter link.

5 Claims, 2 Drawing Figures

KICKBACK-FREE SAW CHAIN

BACKGROUND OF THE INVENTION

One of the greatest problems involved in the use of power chain saws is the so-called "kickback" phenomenon. Kickback is the tendency of a saw to literally throw itself out of the Kerf back toward the operator of the saw. Numerous serious injuries have resulted from chain saw kickback. Indeed, a petition is now pending before the U.S. Consumer Product Safety Commission to establish regulations requiring saw chains to incorporate effective anti-kickback means.

Many attempts have been made to design saw chains which will prevent kickback. Probably the most widely accepted approach is to provide a cam link with an upwardly and rearwardly inclined leading edge preceeding each cutter link to prevent small obstructions from catching against the leading edge of the usual cutter link depth gauge. Examples of such chains are found in Carlton U.S. Pat. No. 3,180,378 and Weiss U.S. Pat. No. 3,910,148. Such chains do reduce the incidence of kickback, but they are only a partial solution to the problem. That is to say, kickback can and does still occur with such chains.

Other attempts at providing a kickback-free chain include Robinson U.S. Pat. No. 3,329,183 which provides a rearwardly projecting tang on the second center link preceeding each cutter link, Anderson U.S. Pat. No. 3,735,662 which discloses a chain utilizing a pair of opposed slitter links followed by a raker link; and Gudmundsen U.S. Pat. No. 2,872,956; Gudmundsen U.S. Pat. No. 2,923,328 and Donley U.S. Pat. No. 2,826,226 which incorporate various types of auxiliary bumper links into the chain.

A particuarly interesting prior art attempt to produce a smooth cutting chain is disclosed in Stihl U.S. Pat. No. 2,963,055 in which a principal depth gauge is mounted on a center link preceeding each cutter link and an auxiliary depth gauge of lesser height is mounted on the cutter link so that as the chain traverses the rounded nose of a saw bar the principal depth gauge pivots out of the way and the effective depth gauge setting of the cutter is increased.

None of the prior art attempts at producing a kickback-free saw chain have been entirely successful. Kickback remains a serious problem for the chain saw industry.

OBJECT OF THE INVENTION

Accordingly, it is an object of the present invention to provide a saw chain which eliminates the dangerous kickback phenomenon.

Another object of the present invention is to provide a saw chain which reduces the effective depth gauge setting of the cutters as the chain traverses the nose of a saw bar.

A further object of the present invention is to provide a saw chain with a desirable, smooth cutting action even during boring.

SUMMARY OF THE INVENTION

These and other objects of the invention are achieved by providing a saw chain comprising a series of center links and pairs of side links pivotally joined to form an articulated chain; certain of said pairs of side links being cutter pairs comprising a non-cutting tie link on one side of the chain and a cutter link bearing an upstanding depth gauge at the front of the link and a cutter tooth rearward of the depth gauge comprising an upstanding shank portion and a laterally extending toe portion; the pair of side links immediately preceeding each cutter pair being a safety pair comprising a non-cutting tie link on the same side of the chain as the following cutter link and a non-cutting safety link on the opposite side of the chain from the following cutter link; said safety link comprising an upstanding cam portion having an upwardly and rearwardly inclined leading edge and rearwardly projecting tail; said tail being configured to reduce the effective depth gauge setting as the chain traverses the rounded nose of a saw bar.

BRIEF DESCRIPTION OF THE DRAWINGS

The invention will be described in greater detail with reference to the accompanying drawings wherein.

DETAILED DESCRIPTION OF THE PREFERRED EMBODIMENT

Figures 1, 2:
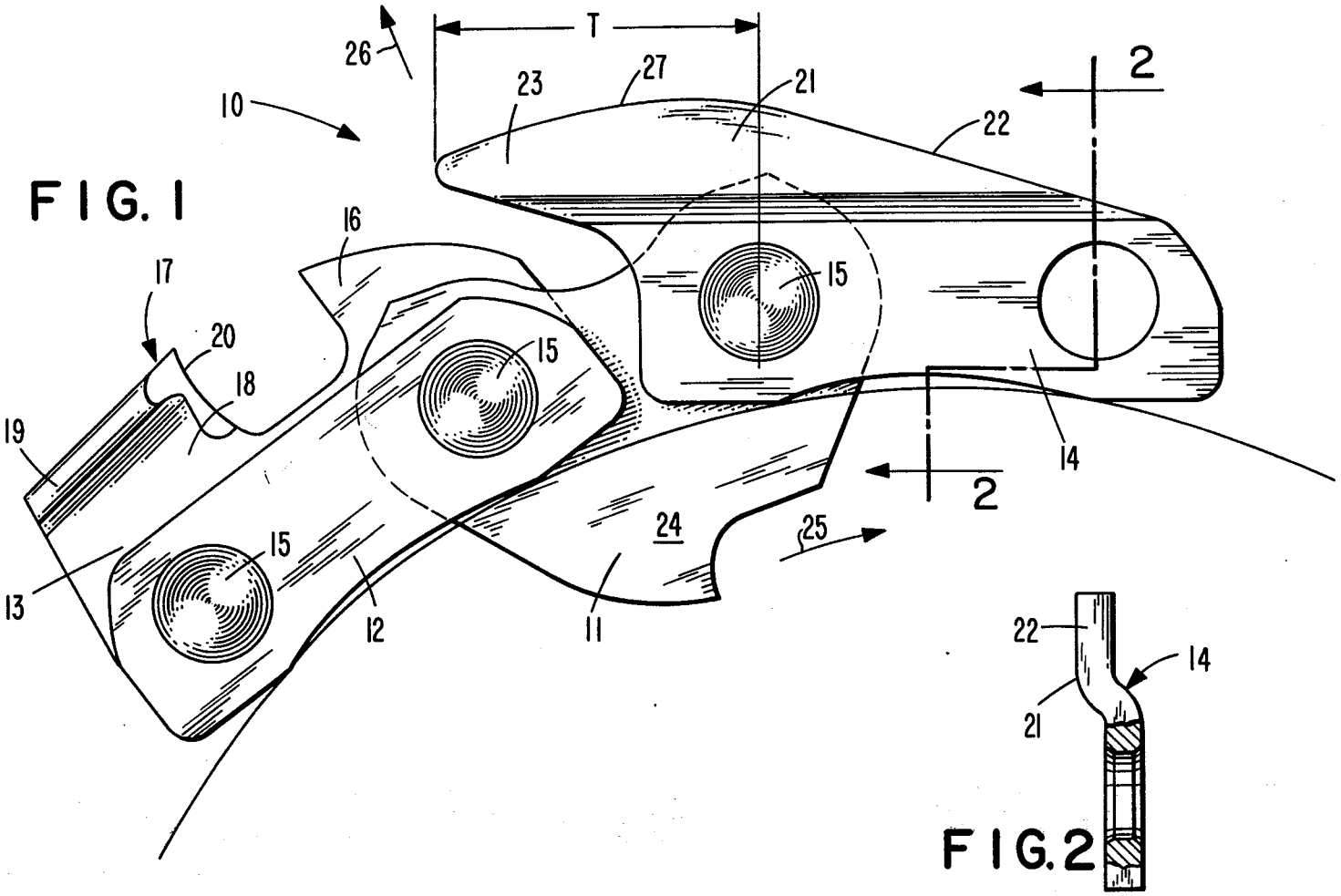
FIG. 1 is a side elevation view of a saw chain according to the present invention.
FIG. 2 is an end view of the safety link illustrated in FIG. 1 taken along line 2—2.

FIG. 1 illustrates a saw chain constructed according to the present invention generally designated by reference numeral 10 comprising a series of center links 11 and pairs of side links 12, 13, 14 pivotally joined by means of rivets 15 to form an articulated chain. Each center link 11 is provided with a downwardly extending drive tang 24 adapted to ride in the groove of a conventional saw bar and engage the teeth of a saw chain drive sprocket in order to drive the chain. Some of said pairs of side links are cutter pairs comprising a non-cutting tie link 12 on one side of the chain and a cutter link 13 on the opposite side of the chain bearing an upstanding depth gauge 16 at the front of the link and a cutter tooth 17 comprising an upstanding shank portion 18 and a laterally extending toe portion 19 rearward of the depth gauge. The leading edge of the shank and toe portions is sharpened to form a continuous cutting edge 20.

The pair of side links immediately preceeding each cutter pair is a safety pair comprising a non-cutting tie link on the same side of the chain as the following cutter link (for reasons of clarity in the drawings, this tie link is not shown, but it is to be understood to be identical to tie link 12 of the cutter pair) and a non-cutting safety link 14 bearing an upstanding cam portion 21 having an upwardly and rearwardly inclined leading edge 22 and a rearwardly projecting tail 23.

As shown in FIG. 2, cam portion 21 is preferably laterally offset away from the center of the chain to provide increased chip carrying capacity.

The upwardly and rearwardly inclined leading edge 22 of cam portion 21 serves to prevent small obstructions from catching against either the cam portion of the safety link or the depth gauge of the cutter link. To effectively perform this function, it is important that the angle of inclination be as shallow as possible, preferably not more than about 20 degrees. In order to achieve this, the inclined leading edge of the link illustrated in the drawings starts at the front of the link, forward of the front rivet hole and the high point of the cam portion is disposed between the center of the rear rivet hole and the rear edge of the body of the link.

All references in this application to the forward direction refer to the direction of chain travel as indicated by arrow 25. All references to the upward direction refer to the direction away from the saw bar as indicated by arrow 26.

As is conventional in saw chains, the height of depth gauge 16 is less than the height of cutter tooth 17. This difference in height is known as the depth gauge setting and determines the depth of the cut made by the cutter tooth as it travels along the straight portion of the saw bar. This is true because, as the cutter travels along the straight portion of the saw bar, the angle of attack of the cutter is parallel to the direction of chain travel. However, due to the circular motion of the cutter as it traverses the rounded nose of a saw bar, the angle of attack of the cutter shifts so as to increase the depth of the cut made by the cutter. This ability of the cutter to cut more deeply when moving in a circular path is often referred to as an increase in the effective depth gauge setting of the cutter and will be so referred to hereinafter.

The usual saw chain carries approximately eight cutters per foot and travels at a rate of 2,500 feet per minute. Thus, the cumulative effect of a small force acting on each cutter link can be very great indeed. By careful study of high speed movies, I have determined that as a conventional cutter link starts to traverse the rounded nose of a saw bar, the angle of attack of the cutter shifts causing the cutter to bite more deeply into the wood. This, of course, increases the force resisting the motion of the cutter. My studies have shown that the first cutter will cut through the wood but that the second cutter entering the cut will tend to stall causing a buildup of forces which causes kickback.

The increase in the effective depth gauge setting is not trivial. It has been calculated that the effective depth gauge setting of a standard ⅜ pitch cutter having a normal depth gauge setting of 0.025 inch when the chain is travelling along the straight portion of a saw bar, increases to 0.054 inch as the cutter traverses the nose of the saw bar. As previously mentioned, the increase depth of cut increases the resistance to saw chain travel, which leads to stalling of the cutters and kickback of the saw.

To counteract this problem, the rearwardly projecting tail 23 of safety link 14 is specially configured to reduce the effective depth gauge setting of cutter 17 as it traverses the rounded nose of a saw bar. The maximum height of cam portion 21 when the chain is straight is approximately equal to the height of depth gauge 16. Thus, when the chain travels along the straight portion of the saw bar, the depth of cut is determined by the actual height differential between depth gauge 16 and cutter 17. However, as the chain traverses the rounded nose of a saw bar, it will be seen from the drawing that tail 23 pivots outwardly so that the tip of the tail asumes a position higher, i.e., further from the saw bar, than depth gauge 16 so that tail 23 acts as an auxiliary depth gauge limiting the depth of cut taken by cutter 17.

It is preferred that tail 23 be configured to actually reduce the effective depth gauge setting to less than half of the normal depth gauge setting value. For example, in a ⅜ pitch minichisel chain in which the cutters have a standard depth gauge setting of 0.020 inch, the tail of the safety link should swing outwardly a distance sufficient to reduce the effective depth gauge setting of the following cutter to less than 0.010 inch despite the increased angle of attack of the cutter.

The distance which the tail of the safety link will pivot in outward direction as it traverses the nose of a saw bar depends on several factors including the radius of curvature of the saw bar nose, the pitch of the chain, the length which the tail projects behind the rear pivot axis of the safety link and the curvature of the upper surface of the tail of the safety link. Saw bar configurations and chain pitch lengths are relatively standard throughout the industry. It has been found that the radius of curvature of the upper surface of the tail portion ordinarily should range between 1.7 and 2.2 times the pitch length of the chain. Desirably the length T which the tail of the safety link projects beind the rear pivot point of the link is at least approximately equal to the pitch of the following center link so that the tip of the tail will overlie the tie link which is paired with the following cutter link. By approximately equal, I mean a length within plus or minus 0.005 inch of the pitch of the center link. Thus, in a ⅜ pitch semi-chisel chain where the pitch length of the center link is approximately 0.341 inch, a tail length of 0.336 inch has been found satisfactory.

Tests performed on chains constructed as described above have shown absolutely no evidence of kickback while exhibiting a smooth cutting action even when boring.

The foregoing embodiment has been described merely as an example of the invention and is not to be construed as limiting. The scope of the invention is to be limited solely by the scope of the appended claims.

I claim:

1. A saw chain comprising a series of center links and pairs of side links pivotally joined to form an articulated chain; certain of said pairs of side links being cutter pairs comprising a non-cutting tie link on one side of the chain and a cutter link bearing an upstanding depth gauge at the front of the link and a cutter tooth comprising an upstanding shank portion and a laterally projecting toe portion rearward of the depth gauge; the pair of side links immediately preceding each cutter pair being a safety pair comprising a non-cutting tie link on the same side of the chain as the following cutter link and a non-cutting safety link on the opposite side of the chain from the following cutter link; said safety link comprising an upstanding cam portion having an upwardly and rearwardly inclinded leading edge and a rearwardly projecting tail, said tail being configured to pivot outwardly as the chain traverses the rounded nose of a saw bar to reduce the effective depth gauge setting of the following cutter to a value less than one-half the normal depth gauge setting when the chain is travelling along the straight portion of the saw bar, the upper surface of the tail of the safety link being a continuous, smooth curve having a radius of curvature from 1.7 to 2.2 times the pitch length of the safety link, the length of the tail of the safety link being at least approximately equal to the pitch length of the following center link.

2. A saw chain as recited in claim 1 wherein the cam portion of said safety link is laterally offset away from the center of the chain.

3. A saw chain as recited in claim 1 wherein the maximum height of the cam portion of the safety link when the chain is travelling along the straight portion of a saw bar is equal to the height of the depth gauge.

4. A saw chain as recited in claim 1 wherein the upwardly and rearwardly inclined leading edge of the cam portion of the safety link makes an angle of not more than 20 degrees with the direction of chain travel when the chain is travelling along the straight portion of a saw bar.

5. A saw chain as recited in claim 4 wherein the upwardly and rearwardly inclined leading edge of the cam portion of the safety link commences forward of the rivet hole of the link and the maximum height of the cam portion occurs between the rear pivot point and the rear end of the body portion of the safety link.

* * * * *